US006274203B1

(12) United States Patent
Kawaguchi et al.

(10) Patent No.: US 6,274,203 B1
(45) Date of Patent: Aug. 14, 2001

(54) PROCESS FOR THE PRODUCTION OF ARTIFICIAL LEATHER

(75) Inventors: Hiroshi Kawaguchi, Kyoto-fu; Toshiki Igarashi, Fukuoka-ken, both of (JP)

(73) Assignees: Ichikintechnical Co., LTD, Kusatu (JP); Tradik Co. LTD, Kyoto (JP)

( * ) Notice: Subject to any disclaimer, the term of this patent is extended or adjusted under 35 U.S.C. 154(b) by 0 days.

(21) Appl. No.: 09/284,979

(22) PCT Filed: Oct. 5, 1998

(86) PCT No.: PCT/JP98/04478

§ 371 Date: May 10, 1999

§ 102(e) Date: May 10, 1999

(87) PCT Pub. No.: WO99/18281

PCT Pub. Date: Apr. 15, 1999

(30) Foreign Application Priority Data

Oct. 6, 1997 (JP) ..... 9-287646

(51) Int. Cl.[7] ..... C08F 2/22; C08F 2/46; B05D 3/02; B05D 3/06; B05D 5/00

(52) U.S. Cl. ..... 427/493; 427/522; 427/544; 427/377; 427/389.9

(58) Field of Search ..... 427/493, 513, 427/521, 522, 544, 377, 389.9

(56) References Cited

U.S. PATENT DOCUMENTS

| | | | | |
|---|---|---|---|---|
| 3,281,258 | * | 10/1966 | Callahan | 427/493 |
| 3,376,158 | * | 4/1968 | Buser . | |
| 3,607,692 | * | 9/1971 | Sanner et al. . | |
| 3,778,294 | * | 12/1973 | Krauch et al. | 427/513 |
| 3,837,900 | * | 9/1974 | Englert et al. | 427/493 |
| 3,876,446 | * | 4/1975 | Bleckmann et al. | 427/513 |
| 4,324,827 | * | 4/1982 | Obayashi et al. | 427/513 |
| 4,393,187 | * | 7/1983 | Boba et al. | 427/493 |
| 4,622,238 | * | 11/1986 | Franz et al. | 427/513 |
| 4,701,345 | * | 10/1987 | Giatras et al. | 427/521 |
| 5,296,271 | * | 3/1994 | Swirbel et al. | 427/493 |
| 5,409,740 | * | 4/1995 | Brann | 427/513 |

FOREIGN PATENT DOCUMENTS 1-104634 4/1989 (JP) .

OTHER PUBLICATIONS

Translation of JP 01–104634 to Takeshi Doi et al Apr. 21, 1989 (patent date).*

* cited by examiner

*Primary Examiner*—Marianne Padgett
(74) *Attorney, Agent, or Firm*—Arent Fox Kintner Plotkin & Kahn, PLLC

(57) ABSTRACT

Artificial leather can be produced, without using any organic solvent, by coating or impregnating a fibrous base material to be formed into artificial leather with a polymer solution in the form of an aqueous emulsion, in which the polymer exhibits elasticity when it is solidified and adhered to the base material; and then solidifying and adhering or fixed, in the fibrous base material, the polymer solution contained in the base material using a combination of wet heat (using the heat of water vapor) and microwave heating. Therefore, the method is not harmful to the environment and permits the reduction of the degree of migration as compared with the conventional methods in which the solidification and adhesion or fixation are performed by dry heating while making use of hot air. The method also permits the formation of a product having clear voids (contact-free portions) formed between fibers in the fibrous base material and the impregnated polymer, the voids being indispensable to the handling or feeling of the artificial leather. The resulting product further has gas permeability due to the presence of numerous very fine pores formed by the release of water vapor generated during the solidification and adhesion or fixation of the polymer. There is also observed the presence of porous structures in the polymer solidified and adhered or fixed within the fibrous base material. In addition, the method permits the elimination of the shrinking step which is essential for the conventional processing steps and this correspondingly allows the simplification of the production process. Moreover, the method of the invention permits the reduction of the processing time and the improvement of the production efficiency.

1 Claim, 4 Drawing Sheets

PROCESS FOR THE PRODUCTION OF ARTIFICIAL LEATHER

TECHNICAL FIELD

The present invention relates to a method for manufacturing artificial leather.

BACKGROUND ART

As improved techniques for obtaining artificial leather which is possessed of handling or feeling and quality of the naturally occurring leather having high quality, there have been proposed such techniques as those relating to very fine fibers serving as fibrous base materials; those relating to polymers with which fibrous base materials are coated or impregnated; and those concerning pre-treatments of fibrous base materials prior to the coating or impregnation thereof with the polymers. And means for diluting the polymers used in these techniques are those which make use of, for instance, dimethylformamide (DMF), i.e., an organic solvent harmful to the human body.

In addition to such a problem that this organic solvent would adversely affect the working environment, for instance, in processing fields, the organic solvent suffers from a problem in that since it requires the use of a large amount of water for hot water-washing or water-washing after the treatments, this would result in water pollution and/or air pollution if the used water is discarded. Therefore, the organic solvent present in the discharged water or the exhaust gas must be recovered and the solvent thus recovered should be post-treated in order to eliminate the foregoing problems. Thus, the use of such an organic solvent suffers from such a problem that it requires a great deal of labor and much expenses for these treatments.

In addition, the techniques which make use of organic solvents suffer from a further problem in that they require a large number of processing steps since they comprise, as shown in FIG. 7, the steps of shrinking a fibrous base material; impregnating the material with polyvinyl alcohol (PVA) (i.e., a step of treating the fibrous base material with polyvinyl alcohol to inhibit any adhesion of a polymer to the fibers constituting the base material); drying the impregnated base material; diluting a polymer; coating or impregnating the dried base material with the polymer; solidifying the polymer; washing the base material with hot water or water; squeezing the base material; drying it; and rolling or winding the base material to obtain a product.

To solve these problems, it would be conceivable to inhibit the use of any organic solvent, i.e., to adopt a method comprising the steps of diluting, with water, a polymer in the form of an aqueous emulsion such as a polyurethane resin stock solution in the form of an aqueous emulsion to an appropriate concentration, impregnating a fibrous base material such as a nonwoven fabric with the resulting dilute solution, and then fixing the polyurethane resin onto or into the fibrous base material through drying and curing like the conventional techniques which employ organic solvents.

This method does not use any organic solvent and therefore, permits the elimination of the PVA-impregnation step and the steps subsequent thereto as well as the hot water-washing or water-washing step and the steps subsequent thereto, which are common in the methods utilizing organic solvents. For this reason, the method permits the preparation of a desired product through the steps of shrinking a fibrous base material, coating the base material with a polymer in the form of an emulsion, pre-drying the coated base material, drying it, and adhering or fixing the polymer thus solidified to the base material. Thus, the method is advantageous in that the number of steps required can be reduced, to some extent, as compared with that required for the method which make use of organic solvents.

However, it has been found, as the results of the supplementary examination of this method, that the method suffers from the following problems:

One of these problems is to cause, at the initial stage of drying, the so-called migration phenomenon wherein the polyurethane resin solid content in a polyurethane resin liquid in the form of an aqueous emulsion, with which the fibrous base material is impregnated, travels upon evaporation of water contained in the emulsified aqueous polyurethane resin liquid which is impregnated into the base material. This phenomenon in turn leads to the movement of the resin component from the interior of the base material to the front and back faces thereof along with the evaporated water component and the reduction of the polyurethane resin content in the interior of the impregnated base material. This becomes a main cause of impairing the handling or feeling of the resulting product.

In addition, if the base material impregnated as mentioned above is dried by dry heating and then the polymer is solidified and adhered or fixed to the base material through dry heating using of hot air (of 120 to 150° C.) and if a polyurethane resin in the form of an aqueous emulsion is, for instance, used as the impregnation liquid, the rate of the polyurethane resin solidified and adhered or fixed to the fibers in the fibrous base material is low and on the order of not more than 10%, while the rate observed when using an organic solvent ranges from 25 to 50%. Therefore, there has not been obtained any product having satisfactory handling or feeling.

Due to the increased content of polymer adhered or fixed to the fibrous base material observed when using the conventional method which comprises the steps of drying through dry heating and then solidifying and adhering or fixing through dry heating, the polyurethane resin component is adhered to the fibers in the base material and hardened therein as will be seen from the electron micrograph 5, as a substitute for a figure, showing the structure of artificial leather and therefore, the method suffers from a problem in that it is difficult to process the product in the subsequent processing steps such as the processing step when making use of a technique for processing island-type (or sea island-type) fibers into microfibers, or in the subsequent dyeing step.

In other words, the artificial leather processed according to this method is then subjected to a leaching processing step and/or a dyeing processing step in a jet dyeing machine or a pad-steam dyeing machine. However, the artificial leather of this type causes, for instance, insufficient operation of the jet dyeing machine, the formation of specks due to the leaching in the leaching step and the formation of specks or spots due to dyeing in the dyeing step. In the pad-steam dyeing step, there are also observed such disadvantages that the sheets of artificial leather are liable to come in contact with each other in the steam and that the contact therebetween becomes a cause of color stain.

It is thus an object of the present invention to obtain artificial leather which is soft and has quality almost comparable to that of the naturally-occurring leather, while using a polyurethane resin stock solution in the form of an aqueous emulsion which is never accompanied by problems such as environmental pollution.

DISCLOSURE OF THE INVENTION

According to the present invention, there is provided a method for manufacturing artificial leather, which comprises the steps of coating or impregnating a fibrous base material to be formed into artificial leather with a solution of polymer in the form of an aqueous emulsion, in which the polymer exhibits elasticity when it is solidified and adhered or fixed to the fibrous base material; and thereafter solidifying and adhering or fixing, in the fibrous base material, the polymer in the polymer solution included in the base material using a combination of wet heating and microwave irradiation (microwave heating). The manufacture of artificial leather by such a method permits the considerable reduction of the processing time. Moreover, the artificial leather manufactured according to this method is very soft and elastic as compared with that manufactured using the conventional aqueous polymer solution in the form of an aqueous emulsion, undergoes shrinkage in addition to the solidification and adhesion or fixation by wet heating and shows a low degree of migration as compared with the conventional artificial leather manufactured by solidification and adhesion or fixation through dry heating while making use of hot air. The method permits the formation of a product having voids (contact-free portions) formed between fibers and the impregnated polymer solution, the voids being indispensable to the handling or feeling of the artificial leather. The resulting product further has gas permeability due to the presence of numerous very fine pores formed through the release of water vapor generated during the solidification and adhesion or fixation of the polymer to the base material. In addition, the method permits the elimination of the shrinking step among the processing steps, which is essential for the conventional methods.

BEST MODE FOR CARRYING OUT THE INVENTION

Figure 1:
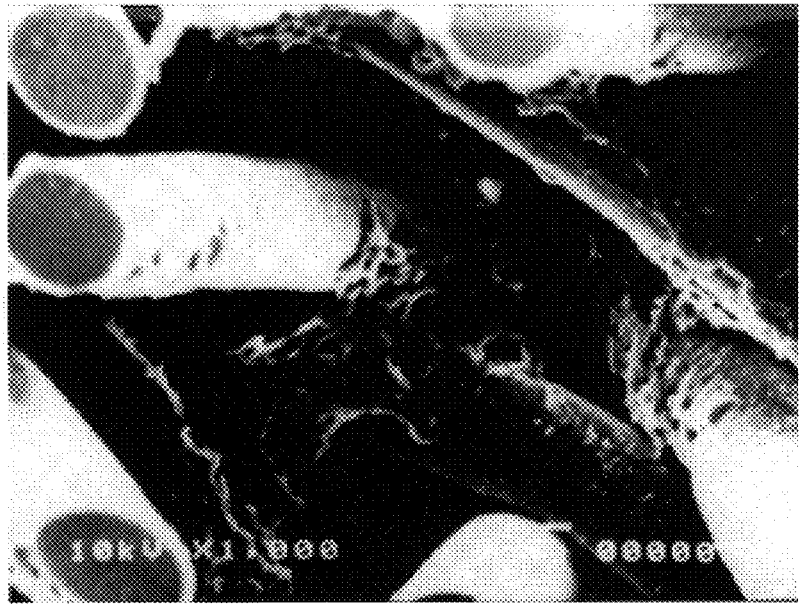
FIG. 1 is an electron micrograph, as a substitute for a figure, showing the structure of artificial leather, as an embodiment, manufactured according to the method of the present invention.
Figure 2:
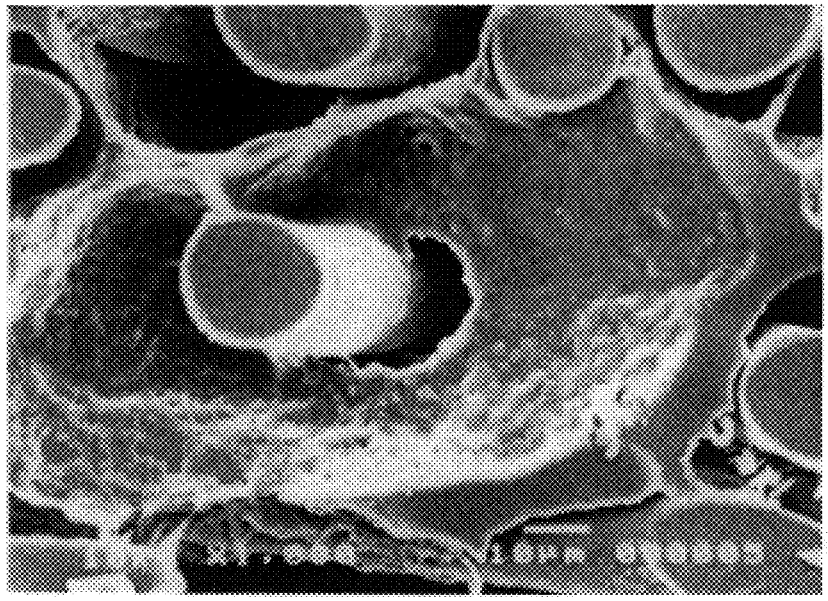
FIG. 2 is an electron micrograph, as a substitute for a figure, showing the structure of artificial leather manufactured in Comparative Example 1.
Figure 3:
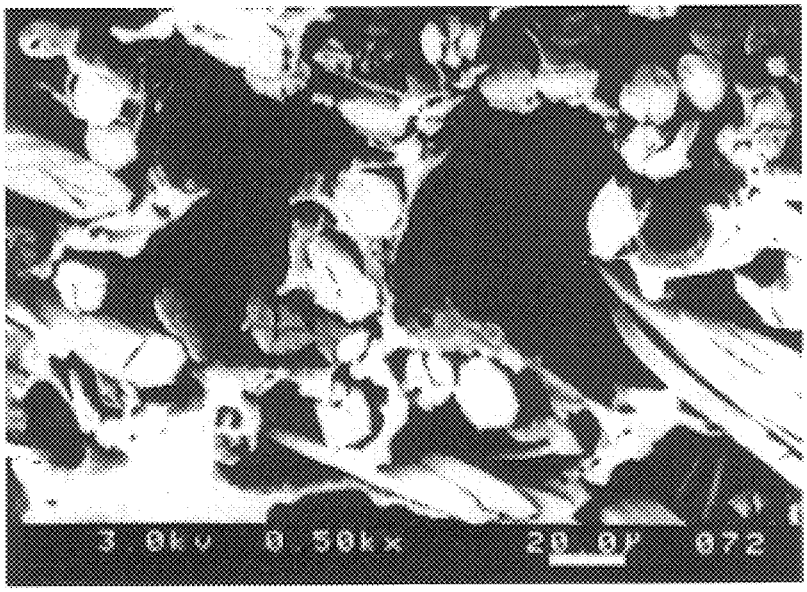
FIG. 3 is an electron micrograph, as a substitute for a figure, showing the structure of artificial leather, as another embodiment, manufactured according to the method of the present invention.
Figure 4:
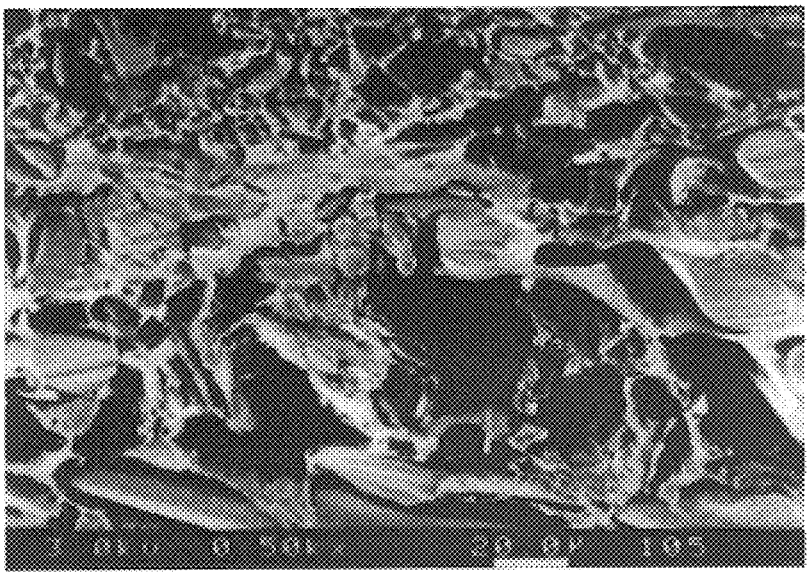
FIG. 4 is an electron micrograph, as a substitute for a figure, showing the artificial leather as shown in FIG. 3 which is subjected to a yarn-dividing/dividing treatment.
Figure 5:
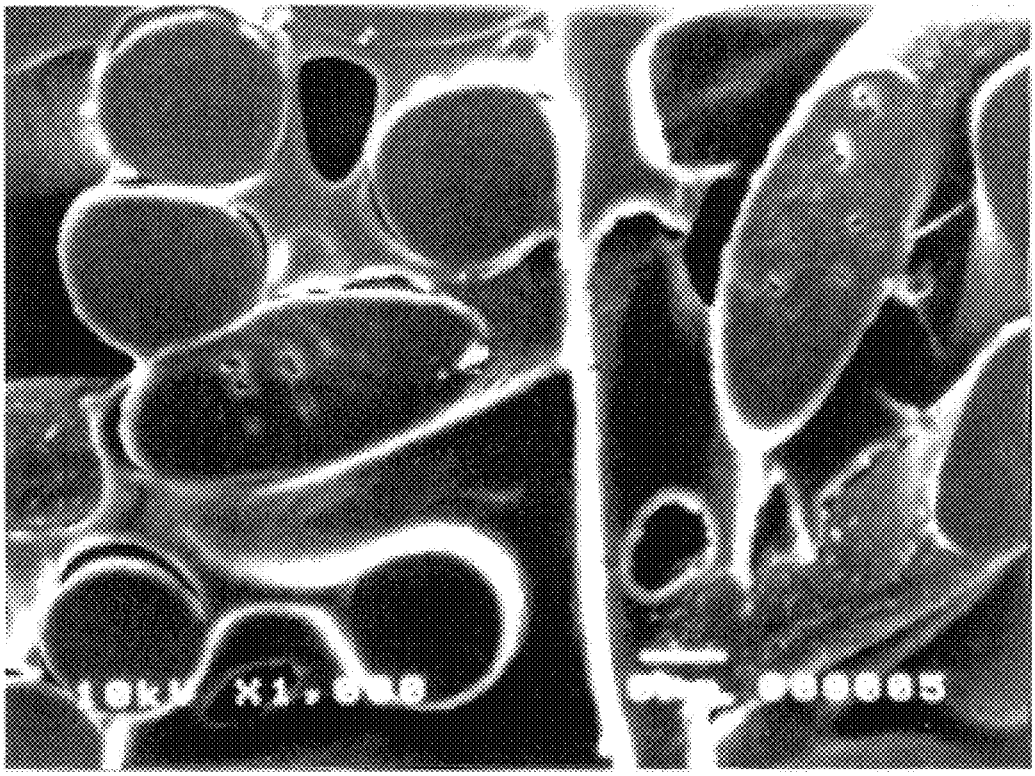
FIG. 5 is an electron micrograph, as a substitute for a figure, showing the structure of artificial leather manufactured by a conventional method.
Figure 6:
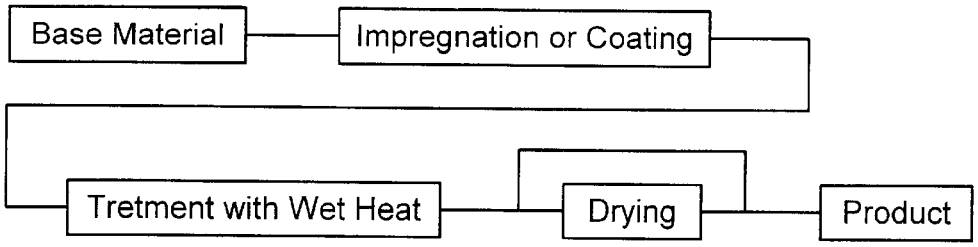
FIG. 6 is a flow diagram of the method according to the present invention.
Figure 7:
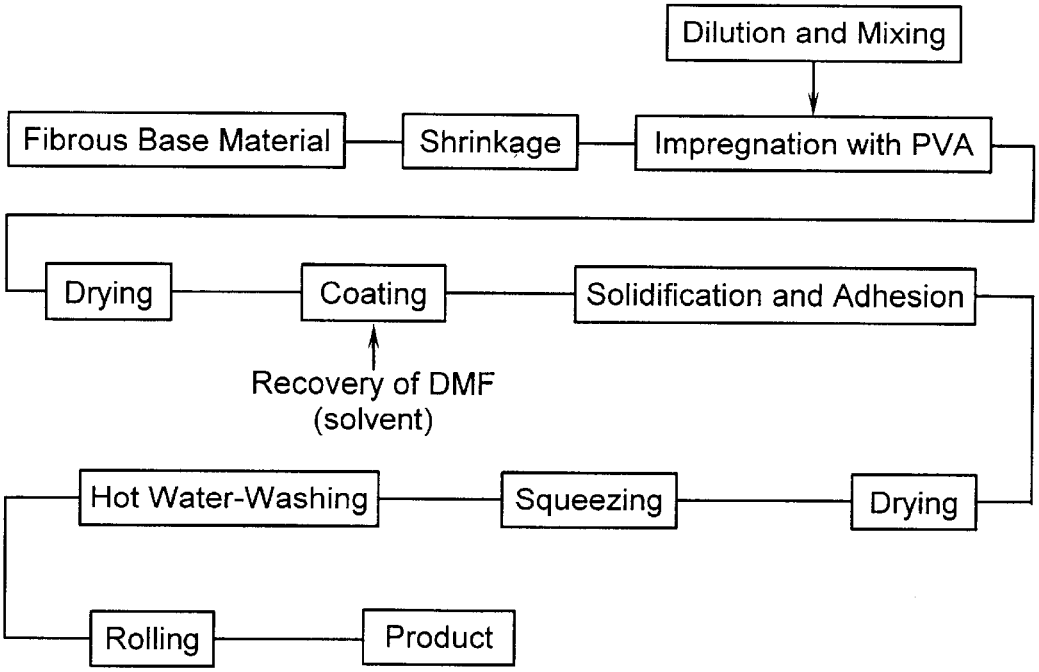
FIG. 7 is a flow diagram of a conventional method.
Figure 8:
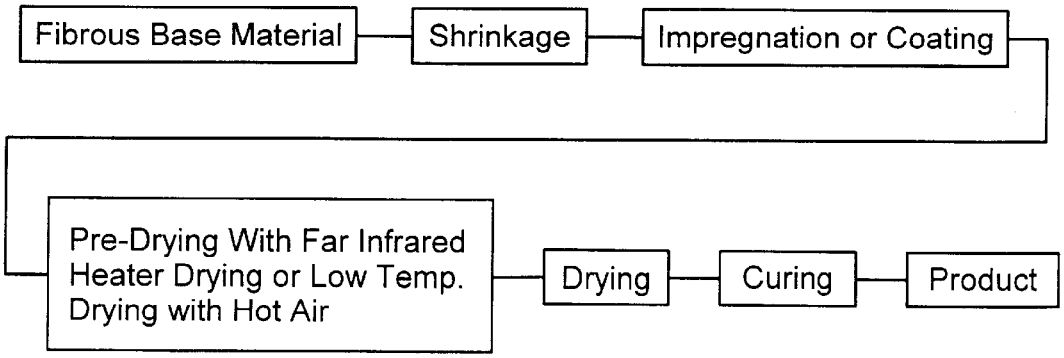
FIG. 8 is a flow diagram of a conventional method.

The present invention will be described in more detail with reference to the attached drawings.

The fibrous base material to be formed into artificial leather herein used may be, for instance, nonwoven fabrics, woven fabrics and knitted fabrics.

Among these fibrous base materials, preferred are nonwoven fabrics prepared from polyamides (nylon fibers) or polyester fibers because they can provide final products having texture almost identical to that of the naturally-occurring leather.

In particular, fibrous base materials comprising copolymerized polyester fibers can be treated with sodium hydroxide to thus easily cause yarn-division/division and therefore, the use of the fibrous base material consisting of copolymerized polyester fibers serves as one of primary factors required for obtaining soft artificial leather.

In addition, to further improve the quality of the final product, it is preferred that the fibrous base material is composed of fibers which are shrinkable in themselves upon heating or contains fibers which are easily shrinkable upon heating.

The fibrous base material is coated or impregnated with a polymer in the form of an aqueous emulsion, which shows elasticity upon solidification and adhesion or fixation (hereinafter referred to as "aqueous elastic polymer"). The coating or impregnation of the base material with the aqueous elastic polymer may be carried out according to a method in which the base material is subjected to this treatment before or after the material is subjected to the yarn-dividing/dividing treatment.

As methods for coating the base material with the aqueous elastic polymer, there may be listed, for instance, direct coating, reverse coating, gravure coating and spray coating methods. After the impregnation of the fibrous base material with the aqueous elastic polymer, the base material is squeezed by passing it through squeegee rolls to thus control the impregnation amount of the polymer contained in the base material.

In this connection, the aqueous elastic polymer used is prepared by dispersing a polyurethane resin in an aqueous medium using an aqueous dispersant to give an aqueous emulsion.

After coating or impregnating the fibrous base material with the aqueous elastic polymer, the aqueous elastic polymer is solidified and adhered or fixed, through wet heating, to the base material using a solidification-adhesion device (hereinafter referred to as a "steamer") which makes use of a combination of the heat of steam (wet heat) with microwave heating.

In this respect, if the fibrous base material comprising copolymerized polyester fibers is subjected to solidification and adhesion treatments and then treated with sodium hydroxide to cause yarn-division/division, it is preferred to use an emulsion of an isocyanate type polyether polyurethane resin having durability and resistance to alkalis and more specifically an emulsion prepared by forcing an urethane polymer carrying terminal isocyanate groups to emulsify using an emulsifying agent and then subjecting the urethane polymer to a chain-extension reaction using a polyamine to form an emulsion of an isocyanate type polyether polyurethane resin.

Incidentally, if the fibrous base material has shrink properties, the base material undergoes shrinkage simultaneous with the solidification and adhesion through wet heating and accordingly, the base material is advantageous in that the shrinkage step carried out prior to solidifying and adhering, through wet heating, the conventional aqueous elastic polymer can be omitted.

The solidification and adhesion or fixation treatments through wet heating are preferably carried out within a steam atmosphere having a humidity of 100% by volume (a saturated steam atmosphere). However, it is also possible to use superheated steam in place of the saturated steam.

The polyurethane resin as the aqueous elastic polymer present in the fibrous base material can be heated up from the inside thereof by irradiating the material with microwaves and for this reason, the aqueous elastic polymer can be solidified and adhered or fixed to the base material within a very short period of time as compared with Comparative Example 1 in which the solidification and adhesion or fixation treatments are carried out using only wet heat.

Further, the irradiation with microwaves can ensure more uniform solidification and adhesion or fixation of a polyurethane resin as the aqueous elastic polymer to the fibrous base material, permits the formation of numerous voids or pores within the adhered polyurethane resin per se (i.e., the formation of porous resin) and thus, the handling or feeling of the leather-like sheet immediately after the solidification and adhesion through wet heating is tender and soft to the touch as compared with that observed for the sheet prepared by the conventional dry solidification and adhesion (curing). Then the leather-like sheet is dyed while it is still in the wet state.

As methods for dyeing the sheet, there may be listed, for instance, the pad-steam dyeing method and the jet dyeing method, with the latter dyeing method being more preferred from the viewpoint of handling or feeling since the sheet is dyed while it is crumpled in the dyeing bath.

The leather-like sheet thus dyed is subjected to a finishing treatment such as buffing according to need to thus give final artificial leather. In this regard, the artificial leather manufactured according to this method exhibits good gas permeability because of the presence of numerous fine pores formed within the polyurethane resin through the evaporation of steam during the solidification and adhesion of the resin.

In the foregoing, there has been described the case wherein the leather-like sheet immediately after the solidification and adhesion through wet heating is directly formed into a final product without subjecting the sheet to any drying treatment. However, if the leather-like sheet immediately after the solidification and adhesion through wet heating is directly subjected to a buffing treatment, the sheet is first dried after the solidification and adhesion through wet heating, prior to the buffing treatment.

The emulsion prepared by dispersing the polyurethane resin in the aqueous medium using the aqueous dispersant is used as the aqueous elastic polymer in the foregoing embodiment, but the present invention is not restricted to the use of this specific aqueous elastic polymer.

EXAMPLE 1

A nonwoven fabric (fibrous base material) having a thickness of 1.4 mm and a basis weight of 300 g/m$^2$ was produced according to the needle punching technique using raw cotton which comprises 50% of polyamide fibers and 50% of polyester fibers and has a separated single filament yarn fineness of 0.2 denier achieved after division.

Then the nonwoven fabric was immersed in a 10% polyurethane resin aqueous solution containing an emulsion of a polyurethane resin, i.e., an emulsion of an aqueous elastic polymer (solid content: 40%) for impregnation, followed by squeezing the fabric with squeegee rolls to thus control the content of the aqueous solution included in the nonwoven fabric. At this stage, the water content of the fabric was found to be 160.3%.

The polymer solution was solidified and adhered or fixed to the fabric, without drying, under the following conditions using the combination of wet heat and microwave heating:

Conditions for Solidification and Adhesion Through Wet Heating

Temperature of Steam: 100 to 110° C.

Processing Time: one minute

Power of Microwave: 10 KW

The rate of water evaporated from the nonwoven fabric, observed after the solidification and adhesion or fixation by wet heating, was found to be 31.6%. Moreover, the hardness and the shrinkage factor of the fabric are listed in the following Tables 1 and 2, respectively.

Then the leather-like sheet prepared by the foregoing method was introduced into a jet dyeing machine without drying and it was found that the sheet could smoothly be introduced into the machine and smoothly traveled without causing any clogging of the nozzles of the machine even after the cloth sewing.

The sheet in this state was dyed brown under the following conditions:

| | |
|---|---|
| Kayanol Brown RX (available from Nihon Kayaku K.K.) | 2% o.w.f |
| Ionet SAD (available from Sanyo Chemical Industries, Ltd.) | 0.5% o.w.f. |
| Sodium Acetate | 0.5 g/l |
| Acetic Acid | 0.3 cc/l |
| Dyeing Temperature | 98° C. |
| Dyeing Time | 60 minutes |

After drying the dyed sheet, it was inspected for the weight of a piece of the sheet having a predetermined area observed before and after the dyeing step and it was found that the weight of the polyurethane resin obtained after the dyeing step was reduced by 3%.

After the leather-like sheet was dried, it was then subjected to a buffing treatment with sand paper to thus give artificial leather having suede-like appearance.

The artificial leather thus produced was found to be very soft and rich in elastic force as compared with the conventional artificial leather although the shrinking step was omitted.

In addition, the leather-like sheet underwent shrinkage simultaneous with the solidification and adhesion or fixation by wet heating and showed a low degree of polymer-migration as compared with the conventional artificial leather prepared by adhesion through dry heating while making use of hot air. There was observed the formation of numerous voids (contact—free portions) formed between fibers and the polyurethane resin, i.e., the elastic polymer, as will be seen from the electron micrograph 1 (the product free of any yarn-dividing/dividing treatment after impregnation) as a substitute for a figure, the formation of such voids being indispensable to the handling or feeling of the artificial leather. There was also observed the formation of the elastic polymer having a porous structure.

Moreover, the rate of solidification and adhesion or fixation of the polyurethane resin to the base material was found to be very high as shown in Table 3.

COMPARATIVE EXAMPLE 1

A nonwoven fabric prepared by the same method as used in Example 1 was immersed in the same aqueous polyurethane emulsion-containing aqueous solution as used in Example 1 for the purpose of impregnation of the fabric with the solution, followed by squeezing the fabric with squeegee rolls to thus control the amount of the aqueous solution contained in the nonwoven fabric, and then subjecting the fabric to solidification and adhesion or fixation through wet heating under the following conditions, in place of the treatment with the steamer used in Example 1. At this stage, the water content of the fabric was found to be 156.4%.

The nonwoven fabric was solidified and adhered or fixed through wet heating under the following conditions, without drying the same:

Temperature of Steam: 100 to 110° C.

Processing Time: 4 minutes

The rate of water evaporated from the nonwoven fabric observed after the solidification and adhesion by wet heating was found to be 30.9%. Moreover, the hardness and the shrinkage factor thereof are listed in the following Tables 1 and 2, respectively.

Then the leather-like sheet prepared by the foregoing method was finished through dyeing, without drying, according to the same method as used in Example 1.

As a result, it was found that it took a long time for the solidification and adhesion or fixation, as compared with Example 1. There was observed the formation of voids (contact-free portions) formed between fibers and the polyurethane resin, i.e., the elastic polymer, as will be seen from the electron micrograph 2 (the product free of any yarn-dividing/dividing treatment after impregnation) as a substitute for a figure, the formation of these voids being indispensable to the handling or feeling of the artificial leather. However, the rate of the voids formed is lower than that observed in Example and the resulting artificial leather is inferior to that of Example in the touch and resilient feeling. Moreover, the artificial leather is also inferior to that of Example in the porosity of the polyurethane resin adhered to the base material and in the soft feeling.

COMPARATIVE EXAMPLE 2

A nonwoven fabric similar to that produced in Example 1 was subjected to a shrinking treatment under the same temperature and humidity conditions as used in Comparative Example 1 for the solidification and adhesion or fixation by wet heating. At this stage, the shrinkage factor of the nonwoven fabric was determined and listed in the following Table 2 and this was close to that observed for the solidification and adhesion or fixation by wet heating in Comparative Example 1.

The nonwoven fabric subjected to the shrinking treatment was immersed in an aqueous polyurethane emulsion-containing aqueous solution under the same conditions as used in Comparative Example 1 (also identical to those used in Example 1) for impregnation of the fabric. At this stage, the water content of the fabric was found to be 150.3%.

Subsequently, the nonwoven fabric was dried and cured (in a dry heat system using hot air) under the following conditions while transferring the fabric using a pin tenter:

Drying: at 120 to 150° C. for 3 minutes

Curing: at 150° C. for 3 minutes

The hardness of the leather-like sheet thus processed was found to be considerably high as compared with that observed in Example 1 as will be seen from the data listed in the following Table 1. It was tried to introduce the leather-like sheet into a jet dyeing machine, but it was found that the introduction was very difficult even when the nozzle diameter was increased because of high bulkiness of the sheet. For this reason, the sheet could not be dyed at all.

EXAMPLE 2

A nonwoven fabric (fibrous base material) having a thickness of 1.3 mm and a basis weight of 255 g/m$^2$ was produced according to the needle punching technique using polyester raw cotton having shrink properties and a fineness of 3 denier.

Then the nonwoven fabric was immersed in an aqueous polyurethane emulsion-containing aqueous solution, i.e., an aqueous elastic polymer for impregnation under the same conditions as used in Example 1, followed by squeezing the fabric with squeegee rolls to thus control the content of the aqueous solution included in the nonwoven fabric. At this stage, the water content of the fabric was found to be 145.9%.

Then the nonwoven fabric was subjected to solidification and adhesion or fixation through wet heating under the same conditions as used in Example 1.

The rate of water evaporated from the nonwoven fabric observed after the solidification and adhesion or fixation by wet heating was found to be 37.4%. Moreover, the hardness and the shrinkage factor thereof are listed in the following Tables 1 and 2, respectively.

In addition, the hardness and shrinkage factor of the fabric observed immediately after the solidification and adhesion or fixation by wet heating are listed in the following Table 1 and 2, respectively and it was found that the fabric was quite soft as compared with the un-treated nonwoven fabric.

Then the leather-like sheet prepared by the foregoing method was introduced into a jet dyeing machine without drying and it was found that the sheet could smoothly be introduced into the machine as compared with the leather-like sheet of Example 1. In addition, it was also found that the sheet smoothly traveled without causing any clogging of the nozzles of the machine even after the cloth sewing.

| The leather-like sheet was dyed under the following conditions: | |
|---|---|
| Dianix brown 3B-FS (available from Mitsubishi Chemical Industries-Hoechst) | 2% o.w.f |
| Acetic Acid | 0.2 cc/l |
| SUNSOLT SN-30 (available from Nikka Chemical Co., Ltd.) | 0.25 g/l |
| Dyeing Temperature | 130° C. |
| Dyeing Time | 30 minutes |

After drying the dyed sheet, it was inspected for the weight of a piece of the sheet having a predetermined area observed before and after the dyeing step and it was found that the weight of the polyurethane resin obtained after the dyeing step was reduced by 5%.

The dried leather-like sheet was then subjected to a buffing treatment with sand paper to thus give artificial leather having the velour-like appearance.

The artificial leather thus produced was found to be soft and rich in elasticity as compared with the conventional artificial leather although the shrinking step was omitted. This could be proved by the facts that the polyurethane resin was sufficiently shrunk in the step of the solidification and adhesion by wet heating, that the leather-like sheet showed a low degree of migration as compared with the conventional artificial leather prepared by the solidification and adhesion through dry heating and that there was observed the formation of voids (contact-free portions) formed between fibers and the polyurethane resin, i.e., the elastic polymer, as will be seen from the electron micrograph 3 (the product free of any yarn-dividing/dividing treatment) as a substitute for a figure, the formation of these voids being indispensable to the handling or feeling of the artificial leather.

Incidentally, the electron micrograph 4 as a substitute for a figure is an electron micrograph of the product which is subjected to the yarn-dividing/dividing treatment, taken at a magnification identical to that for the electron micrograph 3 of Example 2, as a substitute for a figure.

COMPARATIVE EXAMPLE 3

A nonwoven fabric prepared by the same method as used in Example 2 was subjected to a shrinkage treatment under the same temperature and humidity conditions as used in Example 2 for the solidification and adhesion or fixation by wet heating. At this stage, the shrinkage factor of the nonwoven fabric was determined and listed or fixation in the following Table 2 and this was close to that observed for the solidification and adhesion or fixation by wet heating in Example 2.

The nonwoven fabric subjected to the shrinkage treatment was immersed in an aqueous polyurethane emulsion-containing aqueous solution under the same conditions as used in Example I for impregnation of the fabric. At this stage, the water content of the fabric was found to be 145.9%.

Subsequently, the nonwoven fabric was dried and cured (in a dry heat system using hot air) under the same conditions as used in Comparative Example 1, while conveying the fabric using a pin tenter.

The hardness of the leather-like sheet thus processed was found to be considerably high as compared with that observed in Example 1 as will be seen from the data listed in the following Table 1. It was tried to introduce the leather-like sheet into a jet dyeing machine, but it was found that the introduction was very difficult even when the nozzle diameter was increased because of high bulkiness of the sheet. For this reason, the sheet could not be dyed at all.

EXAMPLE 3

Although an aqueous solution of an aqueous polyurethane resin having a concentration of 10% was used in all of the foregoing Examples, the processing time could further be reduced by increasing the resin concentration of the aqueous solution and by the addition of a dielectric substance to the aqueous solution.

This was proved in this Example. A nonwoven fabric produced by the same method as used in Example 1 was used in this Example and there were prepared three kinds of aqueous emulsion-containing aqueous solutions, i.e., 10%, 15% and 20% aqueous polyurethane resin aqueous solutions of an aqueous emulsion (solid content: 40%) identical to that used in Example 1, followed by addition of a dielectric substance, which could easily convert the microwave energy into heat, to these aqueous solutions, immersion of the foregoing nonwoven fabric into each aqueous solution for impregnation, squeezing the fabric with squeegee rolls to control the amount of the aqueous solution included in the nonwoven fabric and then solidification and adhesion or fixation of the solution to the fabric using the same steamer as used in Example 1.

Temperature of Steam: 100 to 110° C.

Processing Time: 15 seconds

Power of Microwave: 10 KW

The results thus obtained are shown in Table 3 and these data indicate that not less than 96% of the polyurethane resin could be solidified and adhered or fixed to the nonwoven fabric when using the 15% polyurethane aqueous solution of the aqueous polyurethane emulsion (solid content: 40%) to which the dielectric substance was added.

Incidentally, there are also listed, in Table 3, the numerical values obtained when using the 20% polyurethane aqueous solution of the aqueous polyurethane emulsion (solid content: 40%) and drying, by dry heating, of the nonwoven fabric under the same conditions as used above, by way of comparison.

In this regard, there can be used, for instance, titanium oxide, barium titanate, silica, magnesium carbonate and diethylene glycol as the dielectric substances.

The use of an increased resin concentration would permit the reduction of the water content of the fabric after the immersion/impregnation and squeezing with squeegee rolls in addition to the achievement of such an advantage that the time required for the solidification and adhesion or fixation can be reduced and the production efficiency can be improved. As a result, the sags and runs of the resin within the nonwoven fabric could be reduced and artificial leather in which the resin was more uniformly solidified and adhered or fixed to the fabric could be produced.

TABLE 1

| Base Material | Sample | Length (mm) | Width (mm) |
|---|---|---|---|
| 50% Polyamide Fibers + 50% Polyester Fibers | Un-processed Sample | 77 | 50 |
| | Ex. 1; irradiated with microwave; solidified and adhered or fixed by wet heating | 119 | 106 |
| | Comp. Ex. 1; solidified and adhered or fixed by wet heating | 117 | 105 |
| | Comp. Ex. 2; solidified and adhered or fixed by dry heating | ≧141 | ≧141 |
| Polyester Fibers | Un-processed Sample | 108 | 118 |
| | Ex. 2; irradiated with microwave; solidified and adhered or fixed by wet heating | 68 | 56 |
| | Comp. Ex. 3; solidified and adhered or fixed by dry heating | ≧141 | ≧141 |

TABLE 2

| Base Material | Sample | Length (%) | Width (%) |
|---|---|---|---|
| 50% Polyamide Fibers + 50% Polyester Fibers | Ex. 1; irradiated with microwave; solidified and adhered or fixed by wet heating | 3.1 | 2.9 |
| | Comp. Ex. 1; solidified and adhered or fixed by wet heating | 3.2 | 2.8 |
| | Comp. Ex. 2; solidified and adhered or fixed by dry heating | 3.6 | 3.2 |
| Polyester Fibers | Ex. 2; irradiated with microwave; solidified and adhered or fixed by wet heating | 16.8 | 19.4 |
| | Comp. Ex. 3; solidified and adhered or fixed by dry heating | 17.7 | 20.7 |

TABLE 3

| | Concentration | | | | | | |
|---|---|---|---|---|---|---|---|
| | 10% (25% aq. sol.) | | 15% (37.5% aq. sol.) | | 20% (50% aq. sol.) | | |
| Conditions | M | S | M | S | M | S | D. H. |
| Weight of Base Material (kg) | 55.47 | 57.47 | 55.34 | 56.68 | 55.39 | 57.12 | 57.80 |
| Weight after Impregnation with Aq. Sol. of Aq. Emul. (kg) | 144.41 | 147.11 | 143.67 | 147.85 | 142.16 | 174.40 | 150.80 |
| PICK UP (%) | 160.30 | 155.9 | 159.6 | 160.8 | 156.6 | 205.3 | 159.87 |
| Polyurethane Solid Content (calculated; kg) | 8.89 | 8.96 | 13.24 | 13.67 | 17.35 | 23.45 | 18.48 |
| Weight after Water-Washing and Drying (kg) | 62.85 | 63.29 | 68.12 | 62.23 | 72.37 | 73.68 | 58.9 |
| Polyurethane Solid Content(kg) | 7.38 | 5.82 | 12.78 | 5.55 | 16.98 | 16.56 | 1.1 |
| Polyurethane Solid Content (%) | 11.74 | 9.19 | 18.76 | 8.91 | 23.46 | 22.47 | 1.86 |
| Rate of Polyurethane Adhesion (%) | 83.0 | 64.9 | 96.5 | 65.17 | 97.75 | 70.61 | 5.95 |

M: Solidified and adhered or fixed using microwave heating and wet heating in combination;
S: Solidified and adhered or fixed using only wet heating;
D. H.: Solidified and adhered or fixed using dry heating.

According to the method of the present invention, artificial leather can be manufactured without using any organic solvent. Therefore, the method is not harmful to the environment and the resulting artificial leather is quite soft and elastic as compared with the conventional artificial leather. Moreover, the method of the present invention permits the shrinkage of the fibrous base material simultaneous with the solidification and adhesion or fixation of polyurethane to the base material through wet heating and the reduction of the degree of migration as compared with the conventional methods in which the solidification and adhesion or fixation are performed by dry heating while making use of hot air. The method also permits the formation of a product having clear voids (contact-free portions) formed between the fibers in the base material and the impregnated polymer, the voids being indispensable to the handling or feeling of the artificial leather. The resulting product further has gas permeability due to the presence of numerous very fine pores formed, in the polymer, by the release of water vapor generated during the solidification and adhesion or fixation of the polymer. There is also observed the presence of porous structures in the polymer solidified and adhered or fixed within the fibrous base material. In addition, the method permits the elimination of the shrinking step which is essential for the conventional processing steps and this correspondingly allows the simplification of the production steps. Moreover, the method of the invention permits the reduction of the processing time and the improvement of the production efficiency.

Industrial Applicability

The artificial leather manufactured by the method according to the present invention can be used as, for instance, a material for the upper for men's and ladies' shoes, sports shoes and casual shoes; a material for bags; and a material for the right side of sofas and seats of cars; as well as a material for preparing blazer coats and gloves and a material for balls such as volleyballs.

What is claimed is:

1. A method for manufacturing artificial leather, comprising the steps of:

coating or impregnating a fibrous base material to be formed into artificial leather with a polymer solution in a form of an aqueous emulsion, in which a polymer formed from the polymer solution exhibits elasticity after being solidified and adhered to the fibrous base material; and then solidifying and adhering, to or in the fibrous base material, the polymer solution coated or impregnated on or in the base material using a combination of wet heating and microwave heating.

* * * * *